US006279454B1

(12) United States Patent
Nishioka et al.

(10) Patent No.: US 6,279,454 B1
(45) Date of Patent: Aug. 28, 2001

(54) FUEL INJECTION PUMP

(75) Inventors: Takao Nishioka; Yasushi Mochida, both of Itami (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 09/294,000

(22) Filed: Apr. 19, 1999

(30) Foreign Application Priority Data

Apr. 24, 1998 (JP) ..... 10-114504

(51) Int. Cl.[7] ..... F01B 11/10
(52) U.S. Cl. ..... 92/169.1; 92/172
(58) Field of Search ..... 92/169.1, 172, 92/248

(56) References Cited

U.S. PATENT DOCUMENTS

| | | | | |
|---|---|---|---|---|
| 4,746,582 | * | 5/1988 | Tsuno | 92/212 X |
| 4,798,770 | * | 1/1989 | Donomoto et al. | 92/212 X |
| 5,226,975 | | 7/1993 | Denton et al. . | |
| 5,372,115 | | 12/1994 | Straub et al. . | |
| 6,073,537 | * | 6/2000 | Noda et al. | 92/31 |

FOREIGN PATENT DOCUMENTS

| | | |
|---|---|---|
| 0 823 551 | 2/1998 | (EP) . |
| 58-146879 | 10/1983 | (JP) . |
| 61-283759 | 12/1986 | (JP) . |
| 5-340213 | 12/1993 | (JP) . |
| 8-232795 | 9/1996 | (JP) . |

OTHER PUBLICATIONS

"Automobile Technical Handbook ", by Automobile Technology Association, vol. 2, p. 50–51 No date.
"Automobile Technical Handbook ", by Automobile Technology Association, vol. 4, p. 198–199 No date.

* cited by examiner

*Primary Examiner*—Hoang Nguyen
(74) *Attorney, Agent, or Firm*—McDermott, Will & Emery

(57) ABSTRACT

A fuel injection pump for high pressure injecting gasoline, fuel whose main component is gasoline or light oil having a sulfur content of 0.05% by weight or less by a reciprocation of a piston sliding relative to a cylinder, wherein at least a sliding surface of the piston to slide on the cylinder is made of ceramic and the surface roughness thereof, expressed in ten-point mean surface roughness $R_z$, is 0.05–0.4 $\mu$m in a direction perpendicular to the sliding direction and 0.2–0.6 $\mu$m in a direction parallel to the sliding direction while the surface roughness expressed in the ten-point mean surface roughness $R_z$ of a cylinder sliding surface corresponding thereto is 0.2–0.8 $\mu$m in a direction parallel to the sliding direction. By using the above combination of piston and cylinder, the wear resistance of the piston and cylinder is improved, the durability thereof is improved and the production cost can be largely reduced.

3 Claims, 1 Drawing Sheet

FUEL INJECTION PUMP

BACKGROUND OF THE INVENTION

1. Field of the Invention

This invention relates to a pump for injecting gasoline, fuel whose main component is gasoline or low sulfur light oil into a combustion chamber of vehicle engine (hereinafter referred to as fuel injection pump or called fuel direct injection pump or direct injection pump), and more particularly to the same pump using wear resistant ceramics for its piston.

2. Description of the Prior Art

Recently, an improvement of fuel efficiency of an internal combustion engine of a vehicle has been an important problem in viewpoints of environment of the earth. For the reason, studies on realization of so-called in-cylinder direct fuel injection engine in which gasoline or light oil is directly injected into a combustion chamber of the same engine have been made energetically. The fuel injection pump for use in this engine utilizes a reciprocation of a cam to obtain a sufficient pressure for injecting fuel. Receiving this motion, a piston (or called plunger) is slid reciprocatedly along an internal wall of the cylinder so as to inject fuel into the combustion chamber. This sliding condition is very severe. Therefore, by improving the wear resistance and fatigue characteristic so as to reduce a wear loss, the performance and durability of the fuel injection pump can be improved.

Particularly, the gasoline direct injection engine or diesel direct injection engine of a small passenger vehicle uses gasoline having a very low viscosity and a high volatility or low sulfur light oil having a low sulfur content. In the same engines, lubrication of the piston and cylinder is achieved by these fuels. However, because these fuels have a very low lubricity, the insufficient wear resistance and anti-seizure performance of the piston and cylinder may cause a fatal damage of a pump.

As the countermeasure, conventionally, the configuration of the sliding surface has been devised in various ways. For example, stainless base materials excellent in corrosion resistance are used as a material for the piston and cylinder and its surface is finished to be very smooth, and further to improve the wear resistance at the time of sliding, parallel grooves as shown in FIG. 1*a* or cross hatch lines as shown in FIG. 1*b* are formed in the sliding surface of the piston in a depth of 2–3 $\mu$m max, so as to serve for fuel oil pit thereby increasing sliding lubricity.

According to SAE technical paper 940992, although the shallow cross hatch pattern lines are formed in the cam surface made of metal, the surface roughness of its finished surface is 0.7 $\mu$m in terms of Rmax so that the surface is smooth and fine. In this case, there is no directivity in the surface roughness so that uniform finishing is attained. In this case, the surface needs to be finished smoothly and uniformly, and therefore a very troublesome processing is needed. The smooth finishing of the sliding surface may be attained by honing or the like as described in, for example, "Automobile Technical Handbook", vol. 2, page 51 and vol. 4, page 198 by Automobile Technology Association. In case where fuel having a low sliding lubricity is used, particularly, the same treatment needs to be carried out on an internal wall of the cylinder. However, because this kind of the processing, particularly, processing on the internal wall of the cylinder is very troublesome, there is a problem in productivity.

On the other hand, about an aspect of the material, for example, Japanese Patent Application Laid-Open No.61-283759 has disclosed a case in which SIALON or a composite ceramic material of alumina and zirconia (zirconium oxide) is employed for a roller which is directly in a sliding contact with a cam of a direct injection pump of a diesel engine. However, only if the sliding portion is made of ceramic, in case where a mating member which slides correspondingly is made of metal like steel, its surface needs to be finished to be extremely smooth to relax aggressiveness to the mating member and a sliding resistance relative to the mating member. For example, Japanese Patent Application Laid-Open No. 8-232795 has disclosed a case of a diesel engine using low sulfur light oil as fuel in which ceramic is employed for the sliding portion of the direct injection pump. In the same publication, the sliding surface of the same ceramic is finished to 0.5 $\mu$m or less in terms of ten-point mean surface roughness Rz or 0.1 $\mu$m or less. In the above described cases, because the ceramic sliding surface having a high hardness is finished to be extremely smooth uniformly, usually in a single direction, as described above, it takes much trouble and time for the finishing.

Further, according to Japanese Patent Application Laid-Open No.5-340213, a conventional cheap steel material is used as a sliding portion base material and then smooth film is formed thereon with a hard material, such as CrN, diamond like carbon (DLC) or the like, on the sliding surface of the base material. However, even if these materials are used, the sliding surface needs to be finished to be smooth as described above and additionally, there is a fear that the coated film may be peeled upon sliding. Therefore, there is a possibility that a partial seizure may be caused thereby. As a result, there is a problem that no stabilized wear resistance or anti-seizure performance can be obtained.

SUMMARY OF THE INVENTION

The present invention has been achieved in viewpoints of these problems, and therefore it is an object of the invention to provide a fuel injection pump of a vehicle engine using gasoline having a low sliding lubricity, fuel whose main component is gasoline or low sulfur light oil, and more particularly to the same pump excellent in wear resistance and anti-seizure performance at the time of sliding and which can be supplied at a low price which has not been seen conventionally, specifically a combination of its piston (plunger) and cylinder.

To achieve the above object, the present invention provides a fuel injection pump for high pressure injecting gasoline, fuel whose main component is gasoline or light oil having a sulfur content of 0.05% by weight or less by a reciprocation of a piston sliding relative to a cylinder, wherein at least a sliding surface of the piston to slide on the cylinder is made of ceramic and the surface roughness thereof, expressed in ten-point mean surface roughness $R_z$, is 0.05–0.4 $\mu$m in a direction perpendicular to the sliding direction and 0.2–0.6 $\mu$m in a direction parallel to the sliding direction while the surface roughness expressed in the ten-point mean surface roughness $R_z$, of a cylinder sliding surface corresponding thereto is 0.2–0.8 $\mu$m in a direction parallel to the sliding direction.

Further, the pump having the above structure in which the ceramic is a material made of mainly silicon nitride or SIALON or a material made of mainly zirconium oxide.

DETAILED DESCRIPTION OF THE PREFERRED EMBODIMENTS

Figure 1A:
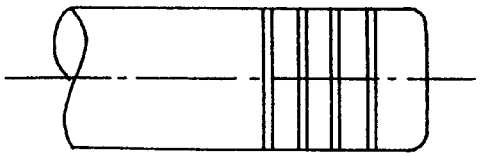
FIG. 1a (PRIOR ART)
FIGS. 1*a* and 1*b* are diagrams schematically showing a conventional piston sliding surface.
Figure 1B:
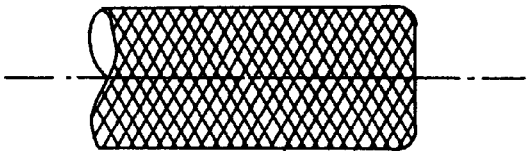
FIG. 1b (PRIOR ART)

A fuel injection pump of the present invention is a fuel injection pump for pressure injecting by reciprocation of a cylinder and a sliding piston. This fuel injection pump injects fuel having a low lubricity such as gasoline, fuel whose main component is gasoline and light oil having sulfur content of 0.05% by weight or less into a combustion chamber. In a piston sliding on its cylinder, at least a sliding surface relative to the cylinder is made of ceramic. By forming the piston of ceramic, mutual seizure never occurs under such a severe lubricating condition and the wear resistance of the piston is remarkably improved.

The sliding surface of the piston of the present invention to slide on the cylinder has a surface roughness expressed in terms of ten-point mean surface roughness $R_z$ which is 0.05–0.4 μm in a direction perpendicular to the sliding direction and 0.2–0.6 μm in a direction parallel to the sliding direction. Preferably, the surface roughness is 0.1–0.3 μm in the direction perpendicular to the sliding direction and 0.2–0.4 μm in the direction parallel to the sliding direction. If the surface roughness exceeds 0.4 μm in the direction perpendicular to the sliding direction or 0.6 μm in the direction parallel to the sliding direction, it is not desirable because the sliding surface of the opposing cylinder is worn. On the other hand, if the surface roughness is less than 0.05 μm in the direction perpendicular to the sliding direction or less than 0.2 μm in the direction parallel to the sliding direction of the piston, it is not desirable because maintenance of lubricating film by fuel is insufficient and it takes much labor and time for the processing.

In the fuel injection pump of the present invention, the surface roughness expressed in ten-point mean surface roughness $R_z$, of the sliding surface of the cylinder which slides relative to the piston shall be 0.2–0.8 μm in the direction parallel to the sliding direction. This reason is that if 0.8 μm is exceeded, there is a possibility that a seizure with the piston may occur at an initial phase of the sliding and additionally the surface does not have to be finished up to as smooth as less than 0.2 μm with much labor and time. If considering economic performance, 0.4–0.8 μm is more preferable. As the material of the cylinder, use of stainless steel is favored if considering durability and economic performance.

The ceramics for use in the piston of the present invention includes those having thermal resistance (characteristic that the surface is not deteriorated) and wear resistance under temperatures up to 150° C. which is the highest use temperature of this kind of the pump, for example, silicon nitride ($Si_3N_4$) or SIALON, composite substance of SIALON and $Si_3N_4$, substance whose main component is silicon carbide (SiC), aluminum oxide ($Al_2O_3$) or zirconium oxide ($ZrO_2$), a composite material of these substances (for example, $Si_3N_4$ or SIALON in which SiC is dispersed, or $ZrO_2$ in which $Al_2O_3$ is dispersed) or a composite material with other component than these substances(for example, $Si_3N_4$ or SIALON in which TiC or TiN is dispersed). Particularly, a material whose main component is silicon nitride ($Si_3N_4$) or SIALON or a material whose main component is zirconium oxide ($ZrO_2$).

In case where the former is used as a piston, it is more excellent in flexural strength, hardness and wear resistance as compared to other ceramic materials and further it has a small density and light weight, so that its driving power can be reduced. Therefore, it is a favorable material from these viewpoints. Specifically, if silicon nitride or SIALON having 80% by weight or more is contained and the three-point flexural strength based on JIS R1601 is at least 700 MPa, it is the most favorable in viewpoint of the durability.

Although the latter has a lower hardness and therefore is poorer in wear resistance, a high flexural strength can be obtained. Further, a material having a high thermal expansion coefficient can be obtained. The thermal expansion coefficient is about $9–11\times10^{-6}$/° C. although it depends on the composition of zirconia and this is larger as compared to other ceramics, for example, alumina of 6.5, silicon carbide of 4.7 and silicon nitride of 3.0 in the unit of $\times10^{-6}$/° C. Therefore, if the same material is used for the piston, in case where the cylinder is composed of steel (about $11–12\times10^{-6}$/° C. although the thermal expansion coefficient depends on the material), a difference in expansion and contraction due to a rise or drop in temperature in a practical temperature range (−50–150° C.) is further decreased. Therefore, a drop in injection pressure due to leak at the time of pressure injecting of fuel become unlikely to occur, and therefore, when it is combined with a steel cylinder, it is the most favorable material as the material of the piston. In case of the piston of the present invention, it can be considered that its surface temperature locally rises to the aforementioned upper limit temperature of 150° C. or higher temperatures at a practical sliding stage. Therefore, where the ceramic whose main component is zirconium oxide is used and the zirconium oxide is mainly composed of tetragonal phase which is metastable at the ambient temperature, it can be considered that crystal transformation from tetragonal phase to monoclinic phase is generated by heat cycle at the practical use time so that flexural strength and wear resistance deteriorate. Therefore, it is favorable to use zirconium oxide in which the proportion of tetragonal phase is not more than 80% under judgment by X-ray diffraction or zirconium oxide having tetragonal phase so composed that this transformation point can be shifted to high temperature side by adding in advance a small amount of aluminum oxide. Although cubic phase zirconium oxide or zirconium oxide containing this is poorer in flexural strength and wear resistance than the aforementioned tetragonal phase zirconium oxide, it can be used effectively as the material of the piston of the present invention because the cubic phase zirconium oxide is stable under high temperatures and has not the aforementioned disadvantages accompanied by the crystal transformation at the practical use time.

The sliding surface of the piston of the present invention to be mated with the cylinder is finished in terms of the surface roughness expressed by the aforementioned ten-point mean surface roughness $R_z$. to 0.05–0.4 μm in the direction perpendicular to the sliding direction and 0.2–0.6 μm in the direction parallel to the sliding direction. As the processing method, an ordinary centerless grinding apparatus is used and a fine-particle diamond grinding wheel of the particle size of more than #1000 is used to perform finish processing. Therefore, multi-step honing processing is not required after the grinding processing unlike the conventional steel plunger. Thus, it is possible to obtain a piston having a desired surface roughness at a very low cost.

Because the aforementioned centerless grinding processing is conducted, the processing pattern is unlike a conventional cross-hatch shallow groove. In the conventional pattern, the surface roughnesses are substantially the same between the directions perpendicular to and parallel to the sliding direction or the difference in surface roughness between these directions is small, but in the pattern by grinding process, the surface roughness in the direction perpendicular to the sliding direction is usually smaller than that in the direction parallel to the sliding direction.

EXAMPLE 1

Figure 2:
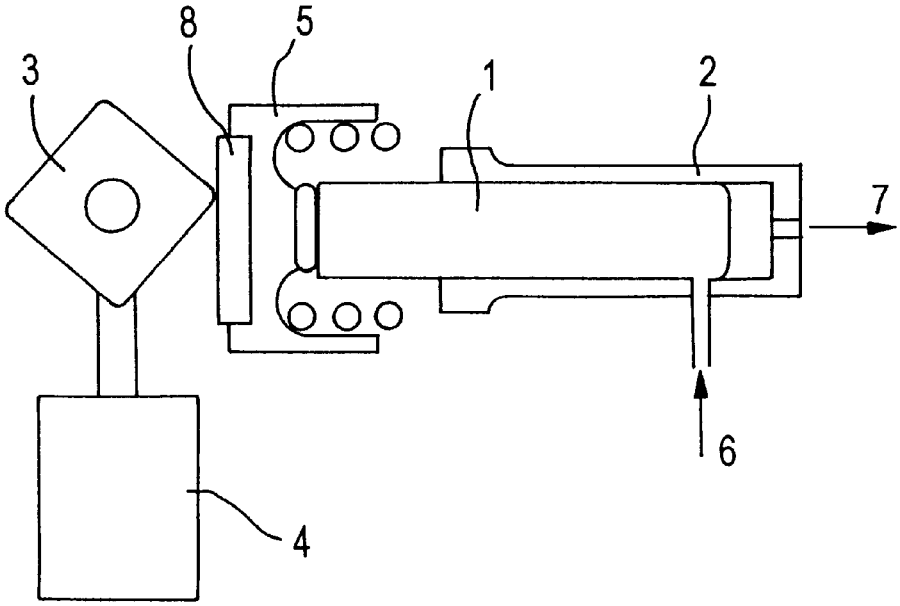
FIG. 2 is a diagram schematically showing a sliding test apparatus used in the examples of the present invention.

FIG. 2 is a diagram schematically showing a test apparatus for evaluating an actual pump according to this Example. In this figure, reference numeral 1 denotes a piston (plunger), numeral 2 denotes a stainless made cylinder, numeral 3 denotes a cast iron cam subjected to chill hardening having four crests for reciprocating the piston 1, numeral 4 denotes a motor for driving the cam 3, numeral 5 denotes a lifter for receiving and transmitting the reciprocation of the cam 3 to the piston (plunger), numeral 8 denotes a tappet shim, numeral 6 denotes a fuel supply port, and numeral 7 denotes an exhaust port. Pistons made of the respective materials described in Table 1 and cylinders of SUS440 were prepared. In this case, the finish surface roughness of the sliding surface of the piston to slide relative to the cylinder was made different in term of the ten-point mean surface roughness between the direction perpendicular to the sliding direction and the direction parallel to the sliding direction as shown in Table 1. The finish surface roughness of the sliding surface of the cylinder to slide on the piston was adjusted to substantially 0.5 $\mu$m in terms of the surface roughness in the direction parallel to the sliding direction. As a comparative example, a conventional piston of SUS 440 was prepared as specimen number 1. These pistons and cylinders were installed on the aforementioned test apparatus under a combination shown in Table 1. A ordinarily sold gasoline was used as fuel and fuel injection test with an actual machine was carried out in the condition that the injection pressure was 10 MPa and the rotation speed of the cam was 2000 rpm. The fuel temperature during the test was 50° C. and a clearance between the piston and cylinder was set to 3–5 $\mu$m at 50° C.

As the material for the piston, a marketed silicon nitride sintered body (described as $Si_3N_4$ in Table 1) having the three-point flexural strength of 850 MPa, a marketed aluminum oxide (alumina) sintered body (shown as $Al_2O_3$ in Table 1) having the three-point flexural strength of 350 MPa and a marketed zirconium oxide sintered body (shown as $ZrO_2$ in Table 1) having the three-point flexural strength of 1100 MPa and containing 80% tetragonal phase were chosen. The sliding surfaces of these materials were finished so as to have the surface roughnesses shown in Table 1 both in the direction perpendicular to the sliding direction and the direction parallel to the sliding direction by combining diamond grinding wheels of #400–#1500. In this case, the finish in the direction perpendicular to the sliding direction of the piston was achieved by the centerless grinding by changing the grinding wheel grit size. The finish in the direction parallel to the sliding direction was achieved by changing the grinding wheel grit size and moving the specimen horizontally in the axial direction. These finishes were carried out step by step so as to obtain each predetermined surface roughness.

Under the above combination of the piston and cylinder, the wear loss and the absence or presence of seizure of the piston and cylinder were checked when 200 hours and 500 hours passed since the operation was started. For the piston, a difference in the outside diameter was confirmed and for the cylinder, a difference in the inside diameter was measured and these values were shown in Table 1 as wear loss thereof. Table 2a) shows processing costs of specimen Nos. 5–7, 10–12 and Table 2b) shows processing costs of specimen Nos. 20–22, 25–27. For a), they are expressed in relative values when the specimen No. 2 is assumed to be 1, and for b), they are expressed in relative values when the specimen No. 17 is assumed to be 1. From the results of Tables 1 and 2, it is apparent that by using a piston having the surface finish state of the present invention, the wear resistance of both the piston and cylinder is improved, the durability thereof as parts is improved and the processing cost can be largely reduced.

TABLE 1

| | | piston surface roughness Rz | | Piston wear loss ($\mu$m) | | Cylinder wear loss ($\mu$m) | |
|---|---|---|---|---|---|---|---|
| No. | Piston material | Perpendicular to sliding direction | Perpendicular to sliding direction | 200 hours | 500 hours | 200 hours | 500 hours |
| *1 | SUS440 | 0.08 | 0.08 | 9.5 | 17.0 | 8.5 | 14.5 |
| *2 | $Si_3N_4$ | 0.02 | 0.1 | 0.8 | 1.2 | 2.0 | 3.0 |
| 3 | " | 0.05 | 0.2 | 0.8 | 1.2 | 2.0 | 3.0 |
| 4 | " | 0.1 | " | 0.8 | 1.2 | 2.0 | 3.0 |
| 5 | " | 0.1 | 0.3 | 0.8 | 1.2 | 1.8 | 2.8 |
| 6 | " | 0.2 | " | 0.8 | 1.2 | 1.6 | 2.4 |
| 7 | " | 0.3 | " | 0.8 | 1.2 | 1.8 | 2.8 |
| 8 | " | 0.4 | " | 0.8 | 1.2 | 4.0 | 6.0 |
| *9 | " | 0.5 | " | 0.8 | 1.2 | 8.0 | 13.0 |
| *10 | " | 0.2 | 0.1 | 0.8 | 1.2 | 1.8 | 3.0 |
| 11 | " | " | 0.2 | 0.8 | 1.2 | 1.8 | 2.8 |
| 12 | " | " | 0.4 | 0.8 | 1.2 | 1.8 | 2.8 |
| 13 | " | " | 0.5 | 0.8 | 1.2 | 1.8 | 3.0 |
| 14 | " | " | 0.6 | 0.8 | 1.2 | 2.5 | 4.5 |
| *15 | " | " | 0.7 | 0.8 | 1.2 | 8.5 | 14.0 |
| 16 | " | 0.4 | 0.6 | 0.8 | 1.2 | 4.5 | 6.5 |
| *17 | $ZrO_2$ | 0.02 | 0.1 | 1.5 | 2.2 | 2.0 | 3.2 |
| 18 | " | 0.05 | 0.2 | 1.5 | 2.2 | 2.0 | 3.2 |
| 19 | " | 0.1 | " | 1.5 | 2.2 | 2.0 | 3.2 |
| 20 | " | 0.1 | 0.3 | 1.5 | 2.2 | 1.6 | 2.8 |
| 21 | " | 0.2 | " | 1.5 | 2.2 | 1.8 | 2.8 |
| 22 | " | 0.3 | " | 1.5 | 2.2 | 1.8 | 2.8 |
| 23 | " | 0.4 | " | 1.5 | 2.2 | 4.0 | 5.5 |
| *24 | " | 0.5 | " | 1.5 | 2.2 | 7.5 | 12.0 |
| *25 | " | 0.2 | 0.1 | 1.5 | 2.2 | 1.8 | 3.0 |
| 26 | " | " | 0.2 | 1.5 | 2.2 | 1.8 | 2.8 |
| 27 | " | " | 0.4 | 1.5 | 2.2 | 2.2 | 3.8 |
| 28 | " | " | 0.5 | 1.5 | 2.2 | 2.4 | 4.6 |
| 29 | " | " | 0.6 | 1.5 | 2.2 | 4.2 | 5.5 |
| *30 | " | " | 0.7 | 1.5 | 2.2 | 7.5 | 12.5 |
| 31 | " | 0.4 | 0.6 | 1.5 | 2.2 | 4.2 | 5.6 |
| 32 | $Al_2O_3$ | 0.2 | 0.05 | 1.4 | 2.0 | 2.0 | 3.0 |
| 33 | " | 0.6 | 0.4 | 1.4 | 2.0 | 4.5 | 6.0 |

NOTE:
*indicates a comparative example.

TABLE 2

| a) | | b) | |
|---|---|---|---|
| No. | processing cost | No. | Processing cost |
| 5 | 0.6 | 20 | 0.5 |
| 3 | 0.5 | 21 | 0.4 |
| 7 | 0.4 | 22 | 0.3 |
| 10 | 0.95 | 25 | 0.9 |
| 11 | 0.4 | 26 | 0.3 |
| 12 | 0.3 | 27 | 0.2 |

EXAMPLE 2

The piston specimens of the specimen Nos. 5 and 20 of Example 1 and cylinders of the same material and shape as Example 1, whose sliding internal surface to slide on the piston was finished to the ten-point mean surface roughness shown in Table. 3 in the direction parallel to the sliding direction were prepared. The initial number of each specimen number of Table 3 indicates the specimen number of Example 1. With a combination shown in Table 3, the same evaluation as Example 1 was carried out using the same test apparatus. The results are shown in the same Table. Table 4 shows processing costs of the specimen Nos. 5–4 –5–6 in relative values when the specimen No. 5–1 is assumed to be 1. From the results of Tables 3 and 4, it is apparent that by using the piston and cylinder having the surface roughness of the present invention, the wear resistance of the piston and cylinder is improved, the durability thereof as parts is improved and cylinder processing cost can be largely reduced.

TABLE 3

| No. | material | surface roughness $R_z$ in a direction parallel to the cylinder sliding direction | Piston wear loss (μm) 200 hours | Piston wear loss (μm) 500 hours | cylinder wear loss (μm) 200 hours | cylinder wear loss (μm) 500 hours |
|---|---|---|---|---|---|---|
| *5-1 | $Si_3N_4$ | 0.1 | 0.8 | 1.2 | 2.0 | 3.0 |
| 5-2 | " | 0.2 | 0.8 | 1.2 | 2.0 | 3.0 |
| 5-3 | " | 0.3 | 0.8 | 1.2 | 2.0 | 3.0 |
| 5-4 | " | 0.4 | 0.8 | 1.2 | 2.2 | 3.4 |
| 5-5 | " | 0.6 | 0.6 | 1.2 | 2.3 | 3.5 |
| 5-6 | " | 0.8 | 0.8 | 1.2 | 2.5 | 3.5 |
| *5-7 | " | 0.9 | 0.8 | 1.2 | 4.0 | 6.5 |
| *20-1 | $ZrO_2$ | 0.1 | 1.5 | 3.0 | 2.5 | 3.0 |
| 20-2 | " | 0.2 | 1.5 | 3.0 | 2.5 | 3.0 |
| 20-3 | " | 0.3 | 1.5 | 3.0 | 2.5 | 3.0 |
| 20-4 | " | 0.4 | 1.5 | 3.0 | 2.5 | 3.0 |
| 20-5 | " | 0.6 | 1.5 | 3.0 | 2.6 | 3.2 |
| 20-6 | " | 0.8 | 1.5 | 3.0 | 2.8 | 3.5 |
| *20-7 | " | 0.9 | 1.5 | 3.0 | 4.0 | 6.2 |

TABLE 4

| No. | processing cost |
|---|---|
| 5-4 | 0.5 |
| 5-5 | 0.4 |
| 5-6 | 0.2 |

As described above, by installing the combination of the piston and cylinder of the present invention in a fuel injection pump for high pressure injecting gasoline, fuel whose main component is gasoline or low sulfur light oil into a combustion chamber of a vehicle engine, the wear resistance at the time of sliding between the piston and cylinder is remarkably improved and provision of a cheap fuel injection pump is enabled.

What is claimed is:

1. A fuel injection pump for high pressure injecting gasoline, fuel whose main component is gasoline or light oil having a sulfur content of 0.05% by weight or less by a reciprocation of a piston sliding relative to a cylinder, wherein at least a sliding surface of said piston to slide on the cylinder is made of ceramic and the surface roughness thereof, expressed in ten-point mean surface roughness $R_z$, is 0.05–0.4 μm in a direction perpendicular to the sliding direction and 0.2–0.6 μm in a direction parallel to the sliding direction while the surface roughness expressed in the ten-point mean surface roughness $R_z$ of a cylinder sliding surface corresponding thereto is 0.2–0.8 μm in a direction parallel to the sliding direction.

2. A fuel injection pump as claimed in claim 1 wherein said ceramic is a material made of mainly silicon nitride or SIALON.

3. A fuel injection pump as claimed in claim 1 wherein said ceramic is a material made of mainly zirconium oxide.

* * * * *